US005340338A

United States Patent [19]

Sai et al.

[11] Patent Number: 5,340,338

[45] Date of Patent: Aug. 23, 1994

[54] FEMALE ELECTRICAL TERMINAL

[75] Inventors: Noriaki Sai, Yokohama; Yoshiji Kinoshita, Kawasaki, both of Japan

[73] Assignee: The Whitaker Corporation, Wilmington, Del.

[21] Appl. No.: 89,008

[22] Filed: Jul. 9, 1993

[30] Foreign Application Priority Data

Aug. 18, 1992 [JP] Japan ..... 4-057905[U]

[51] Int. Cl.[5] ..... H01R 13/00

[52] U.S. Cl. ..... 439/845

[58] Field of Search ..... 439/845, 849, 850, 851, 439/852, 853

[56] References Cited

U.S. PATENT DOCUMENTS

| | | | |
|---|---|---|---|
| 1,291,933 | 1/1919 | Kuhn et al. | 439/845 |
| 2,471,923 | 5/1949 | Batcheller | 439/845 |
| 2,591,009 | 4/1952 | Riche | 439/845 |
| 3,453,587 | 7/1969 | Neidecker . | |
| 3,845,451 | 10/1974 | Neidecker | 439/845 |
| 4,772,218 | 9/1988 | Ross | 439/387 |

FOREIGN PATENT DOCUMENTS

| | | |
|---|---|---|
| 0038431 | 3/1981 | European Pat. Off. . |
| 0268356 | 9/1987 | European Pat. Off. . |
| 61-279076 | 5/1986 | Japan . |

OTHER PUBLICATIONS

Hugin Industries Inc., Guide to Multiple Contact Band Technology, 1990, pp. 7, 8, and 13.

*Primary Examiner*—Joseph H. McGlynn
*Attorney, Agent, or Firm*—Timothy J. Aberle

[57] ABSTRACT

The elastic contact members (18) are provided in curved shape with their front ends (18*a*) fixed to a main body (16) inside a space 14, and their rear ends (18*b*) being able to slide on the main body (16) toward the rear inside of the space (14). Additionally, projecting parts (26) which contact the rear ends (18*b*) prevent more than a specified amount of deformation of the elastic contact members (18). The projecting parts (26) are provided at a specified distance to the rear of the positions of the rear ends (18*b*) of the elastic contact members (18).

11 Claims, 9 Drawing Sheets

16
12
18a
14
24
18
18b
26
18a
26

16
22
12
24
20
18
18b
26
18a
24
20
14
22

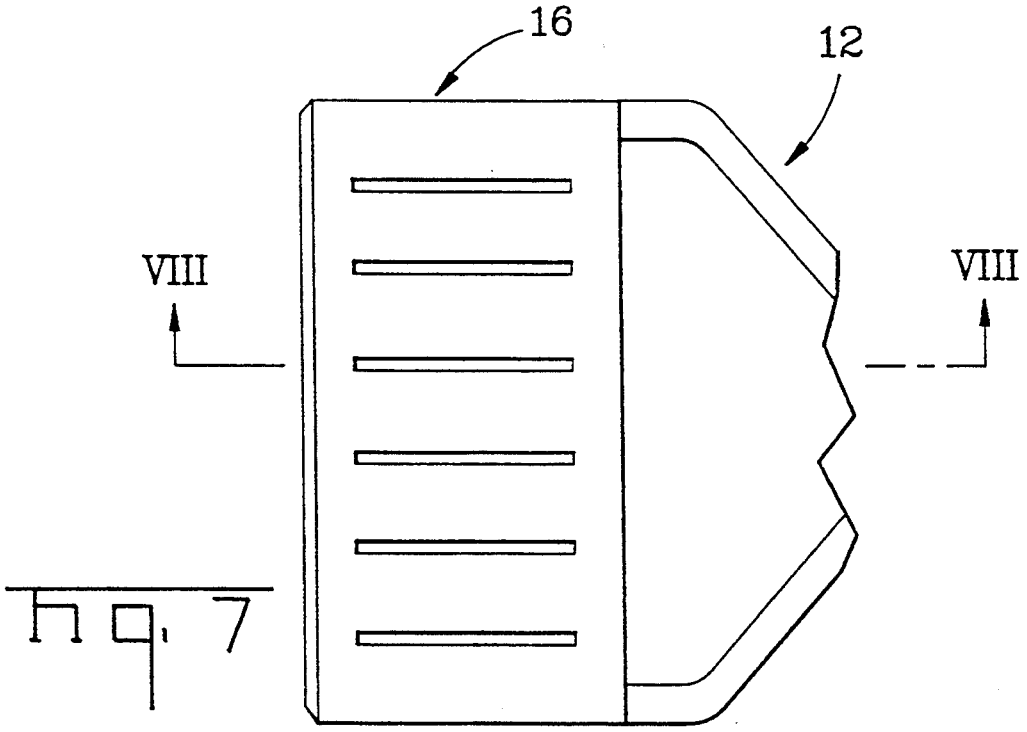
Fig. 7
Fig. 8
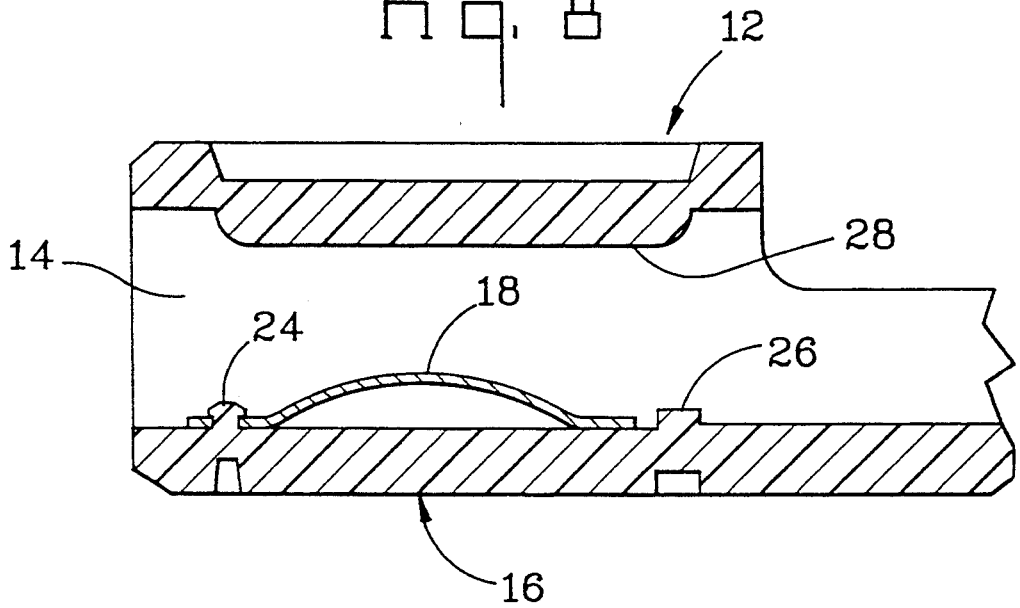

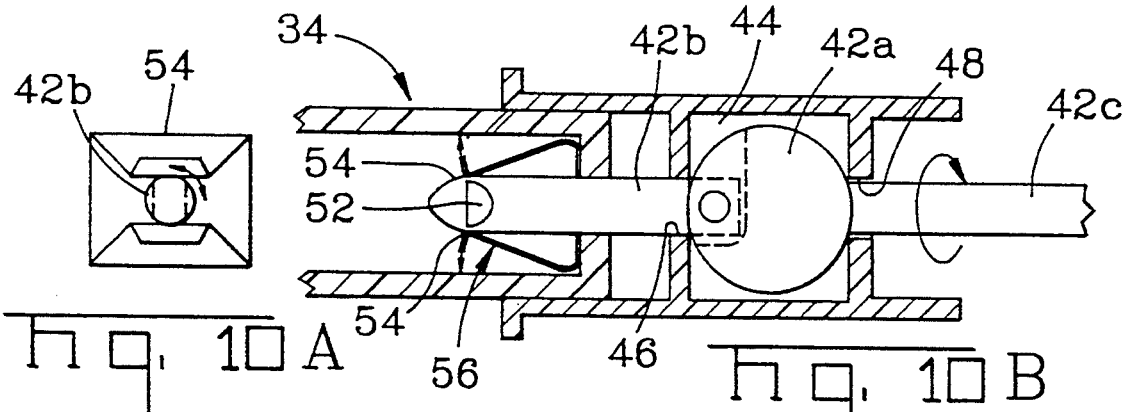
Fig. 10A
Fig. 10B
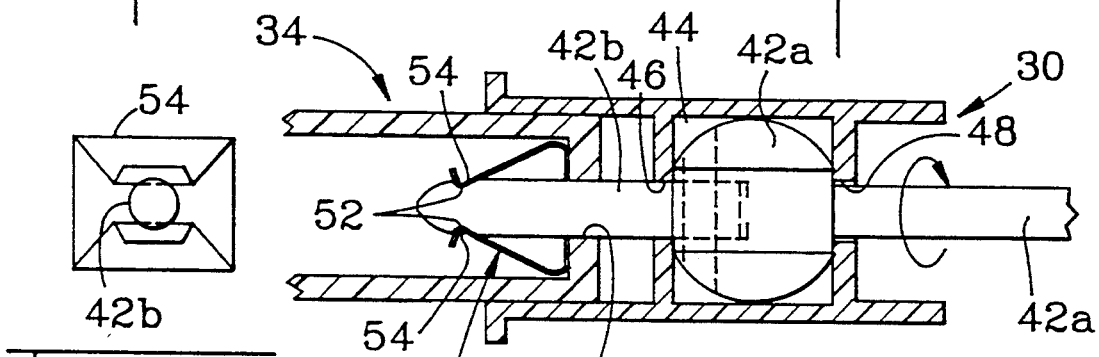
Fig. 11A
Fig. 11B
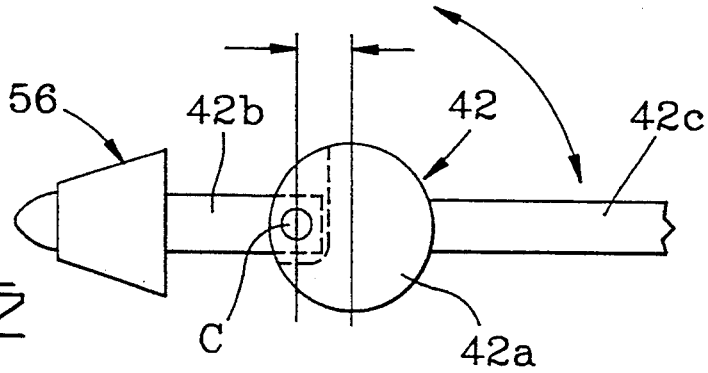
Fig. 12
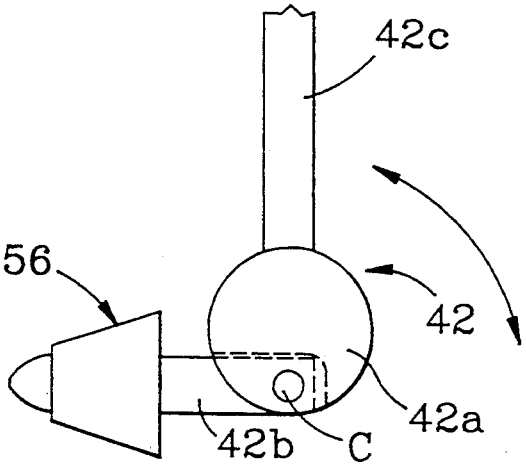
Fig. 13

Fig. 17A
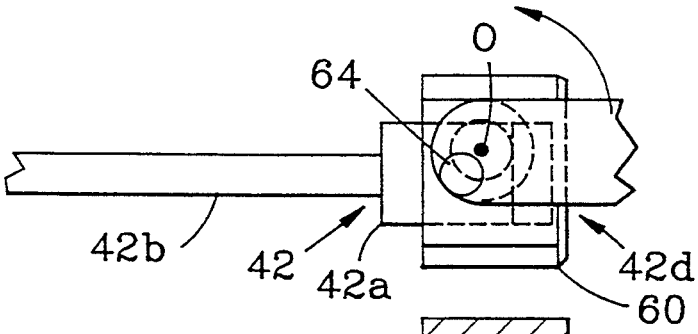
Fig. 17B
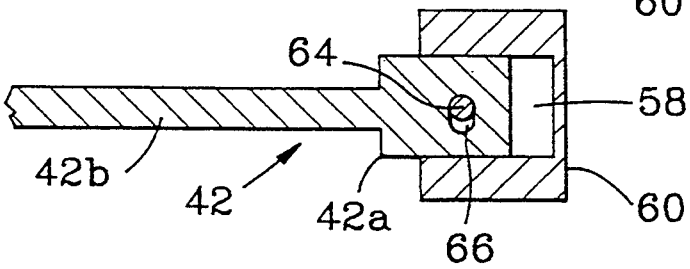
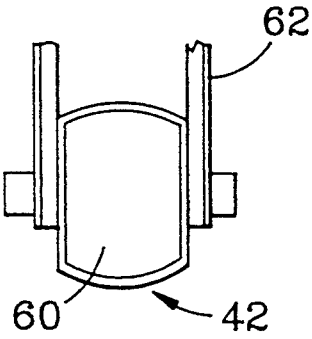
Fig. 18A
Fig. 18B
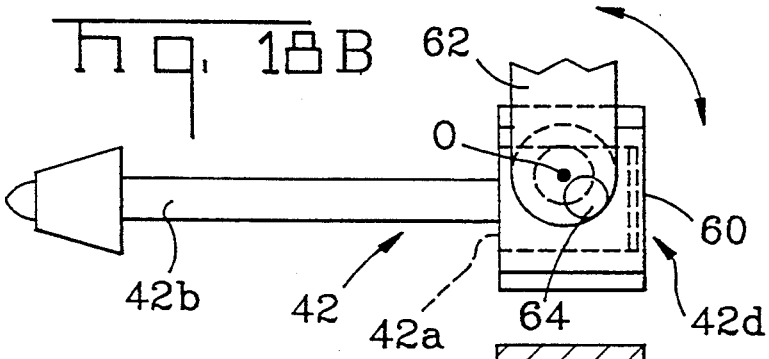
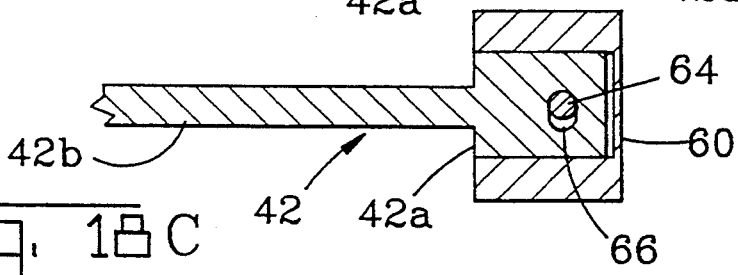
Fig. 18C
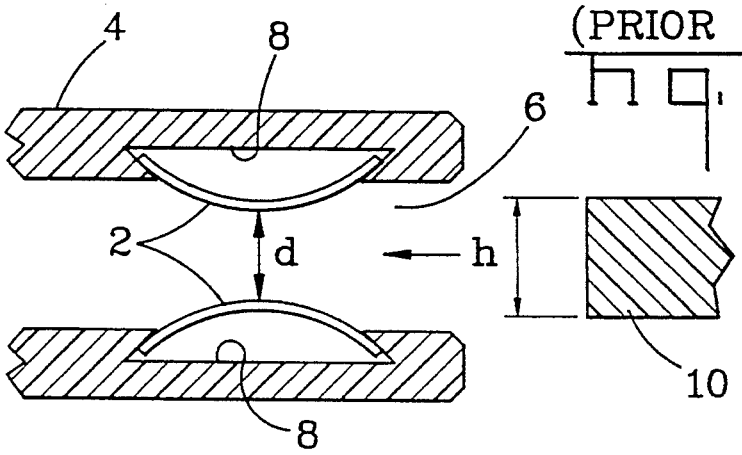
(PRIOR ART)
Fig. 19

FEMALE ELECTRICAL TERMINAL

The present device relates to a female electrical terminal that comprises a main body of approximately box shape that has a space in which the corresponding tab terminal is inserted, and elastic contact members in sheet form that are provided in curved form inside this space and which contact the corresponding tab terminal inserted in the space. In particular, the invention relates to the mounting structure of the elastic contact members.

BACKGROUND OF THE INVENTION

Female electrical terminals comprising a main body made from a conductor that has a space into which the corresponding tab terminal is inserted, and elastic contact members made of conductive material, are provided in a curved form inside the space, as described in *Guide to Multiple Contact Band Technology* (Hugin Industries, Inc.; published Nov. 30, 1990), for example, have been known in the past.

The elastic contact members provided in the female electrical terminal described in the known guide have the following mounting structure. FIG. 19 is a longitudinal section of the guide that shows the mounting structure of the elastic contact members in a conventional female electrical terminal. As shown in FIG. 19, the elastic contact members 2 in sheet form are respectively placed in a pair of dovetail grooves 8 in the top and bottom of the space 6 in the main body 4 so that they extend almost parallel to the insertion direction of the tab terminal 10 while curving to the inside of space 6 so that they can make contact with the corresponding tab terminal 10 inserted in the space 6. Sometimes a multiplicity of slots that extend almost parallel with the insertion direction of the tab terminal, and are aligned in a direction orthogonal to that of the insertion direction (i.e., the direction perpendicular to the page), are formed in the elastic contact members 2 so that they can make uniform contact with the corresponding tab terminal 10.

Considering the functions of the elastic contact members 2 described above, they must be placed so that they reliably contact the corresponding tab terminal 10. However, relative to the ease of inserting and removing the corresponding tab terminal 10, it is desirable that the tab terminal 10 can be easily inserted or removed with a rather small force.

The distance d between the upper and lower elastic contact members 2 in FIG. 19 must be somewhat less than the height h of the tab terminal 10, allowing also for structural error of the corresponding tab terminal 10, in order that those elastic contact members can make reliable contact with the corresponding tab terminal 10. However, if the elastic contact members 2 are placed in dovetail grooves 8 and the positions of both ends are fixed as described above, a considerable force is required to deform the elastic contact members 2 upward and downward. Therefore, with the manner of mounting the elastic contact members 2 described in the above publication, a fairly large force is inevitably necessary when inserting or removing the corresponding tab terminal 10 when the elastic contact members 2 have been placed in the position where reliable contact with the corresponding tab terminal 10 is achieved.

Also, machining was necessary to form such dovetail grooves 8 as shown in FIG. 19, and therefore forming such dovetail grooves was fairly expensive.

The problem that the instant invention solves is: providing a female electrical terminal whereby the corresponding tab terminal can be easily inserted and removed with a small force; reliable contact is effected between the elastic contact members and the corresponding tab terminal; and the female terminal is also easily manufactured so costs can be reduced by devising a mounting structure for the elastic contact members.

SUMMARY OF THE INVENTION

As a means of solving the above problem, the female electrical terminal of this device is a female electrical terminal wherein the elastic contact members are provided in curved shape with their front ends fixed to the main body inside the space, and their rear ends are able to slide against the main body toward the rear inside that space. The invention further includes projecting parts which, when the elastic contact members are pressed by more than a specified load by the tab terminal inserted into the space and deform so that their rear ends move to the rear, make contact with the rear ends of the elastic contact members and control their movement, thus preventing more than a specified degree of deformation of the elastic contact materials. The projecting parts are provided in positions at a specified distance to the rear of the elastic contact members before insertion of the tab terminal in the space.

"More than a specified degree of deformation" of this elastic contact member means, to give an example, deformation such that the elastic contact members are pressed beyond their elastic limits by the inserted tab terminal and plastically deform to an elongated state in the insertion direction.

With the female electrical terminal of the instant invention, if the corresponding tab terminal is inserted inside the space in the main body and contacts the elastic contact members, the elastic contact members are elastically deformed in the forward/rearward direction and in the vertical direction, thereby causing the rear ends to slide to the rear, by the pressure of the tab terminal, and they make reliable contact with the corresponding tab terminal by their restoring force. Also, when the elastic contact members are pressed by more than a specified load by the tab terminal inserted inside the space and their rear ends move to the rear, the projecting parts make contact with the rear ends that have moved, thereby preventing the elastic contact members from deforming more than a specified amount.

By mounting the elastic contact members in a curved shape with only their front ends fixed to the main body and their rear ends able to slide against the main body, the elastic contact members are placed so that they can make reliable contact with the corresponding tab terminal, they can be deformed sufficiently in the vertical direction by a small force. Therefore, the corresponding tab terminal can be inserted and removed with a small force, and reliable contact between the elastic contact members and the corresponding tab terminal can be effected. Also, the elastic contact members can be mounted in the space by fixing only their front ends to the main body, so the laborious and costly job of forming dovetail grooves as in the past in unnecessary. Therefore, the elastic contact members of the present invention are easy to manufacture and costs can be reduced. Moreover, projecting parts such as described above are provided in the female electrical terminal of this device, so that the elastic contact members can be prevented from deforming more than a specified amount if pressed by more than a specified load by the corresponding tab terminal.

Practical examples of the female electrical terminal of this device will now be explained on the basis of the appended drawings.

BRIEF DESCRIPTION OF THE DRAWINGS

FIG. 7 is a frontal view of the female electrical terminal of another practical embodiment of the invention.

FIG. 8 is a cross sectional view shown at line VIII—VIII of FIG. 7.

FIGS. 10–13 show the action of the fitting/removal aid provided in the housing shown in FIG. 9.

FIGS. 15–18 show the action of the fitting/removing aid provided in the housing shown in FIG. 11.

FIG. 19 is a connector according to the prior art.

DETAILED DESCRIPTION OF THE INVENTION

Figure 1:
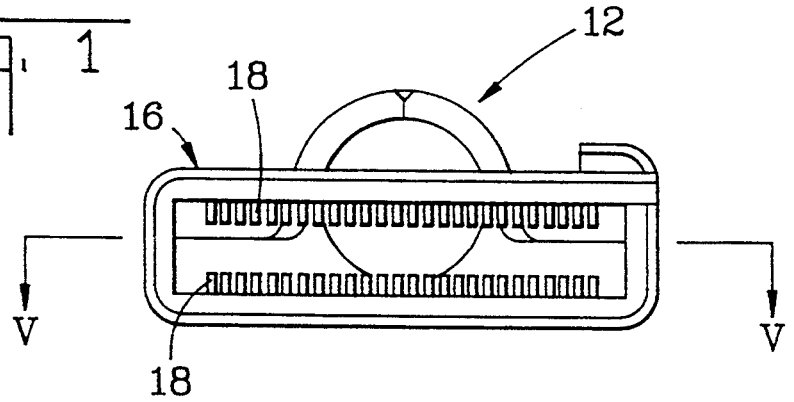
FIG. 1 is a frontal view of the female electrical terminal of one practical embodiment of this device.
Figure 2:
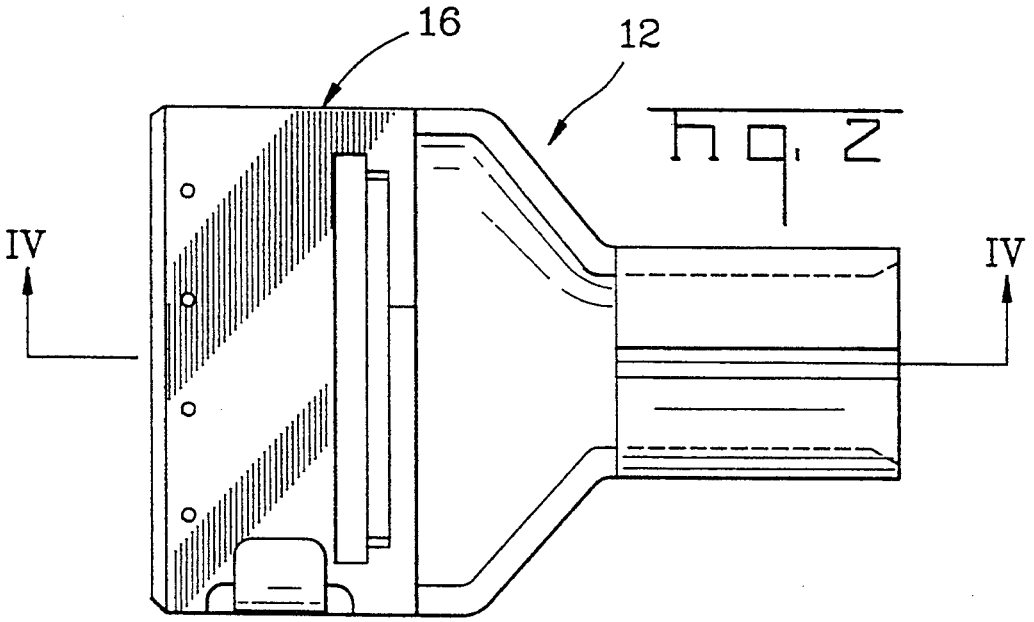
FIG. 2 is a plan view of the female electrical terminal shown in FIG. 1.
Figure 3:
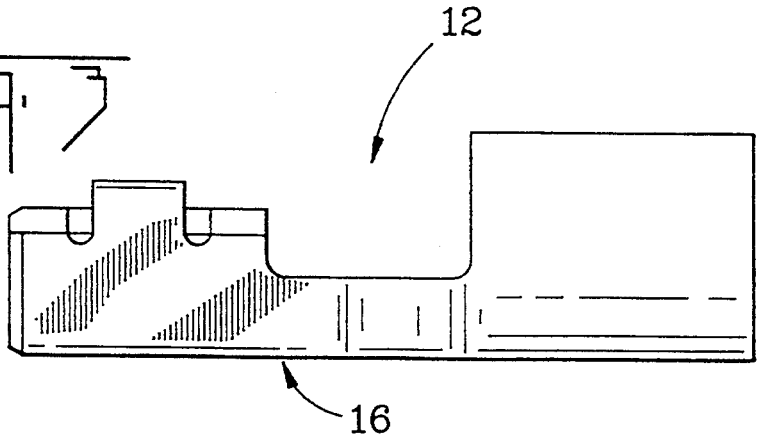
FIG. 3 is a side view of the female electrical terminal shown in FIG. 1.
Figure 4:
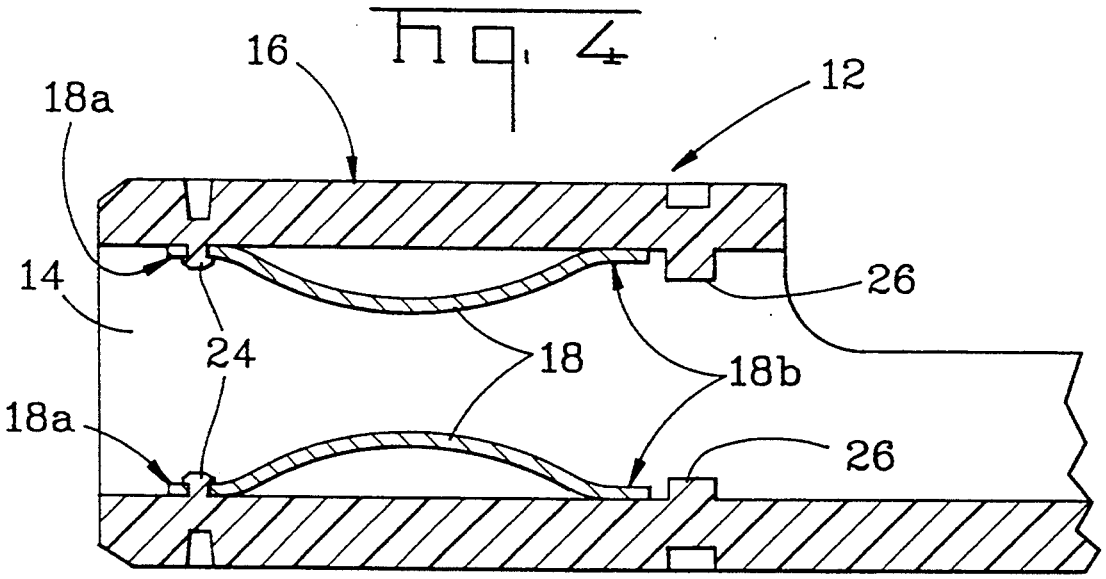
FIG. 4 is a cross sectional view shown at line IV—IV in FIG. 2.
Figure 5:
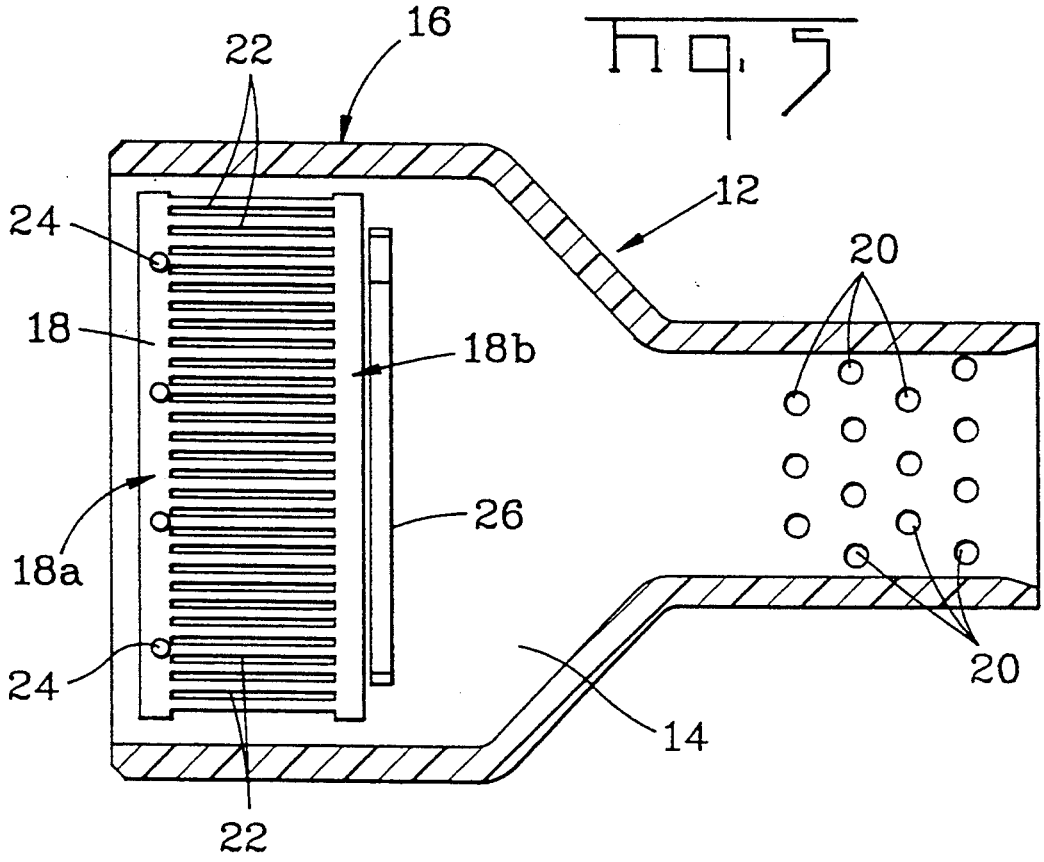
FIG. 5 is a cross sectional view shown at line V—V in FIG. 1.
Figure 6:
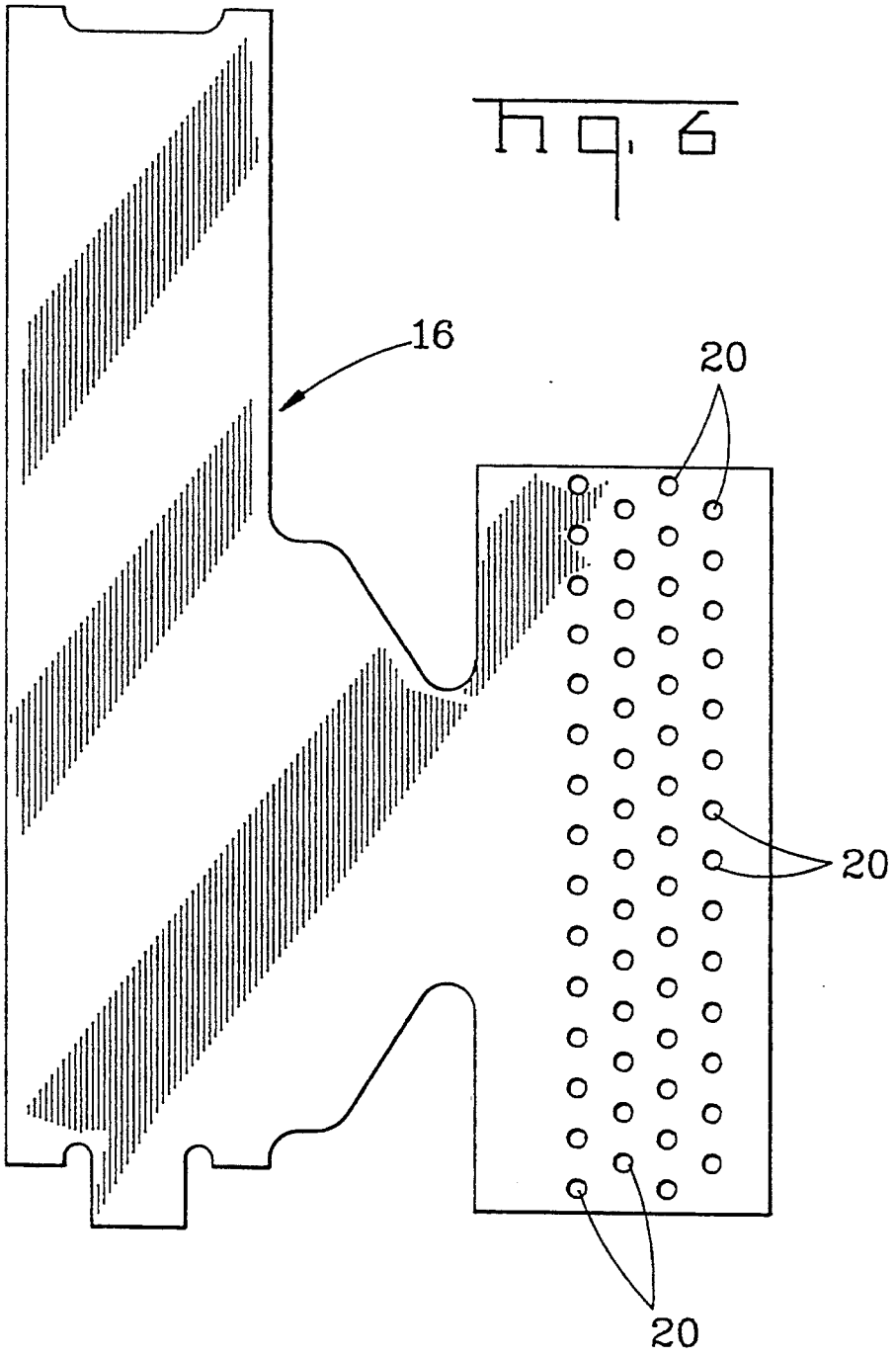
FIG. 6 is a drawing that shows the main body of the female electrical terminal shown in FIG. 1 in a spread out state.

FIG. 1 is a frontal view of the female electrical terminal of one embodiment of this device. FIG. 2 is a plan view of the same, and FIG. 3 is a side view of the same. FIG. 4 is a cross section at the line IV—IV in FIG. 2. FIG. 5 is a cross sectional view at the line V—V in FIG. 1. FIG. 6 shows the main body of the above female electrical terminal in its spread-out state.

As shown in FIGS. 1 through 5, the female electrical terminal 12 of this practical embodiment comprises a main body 16 made of a conductor (metal) of approximately box shape that has a space 14 in which the corresponding tab contact or terminal (not shown) is inserted and elastic contact or sheet-spring members 18 made from a pair of sheet conductors (metal) that are placed above and below inside the main body 16.

As shown in FIG. 6, the main body 16 is formed by bending the sheet conductors, which have a large number of bosses 20 (FIG. 5) formed in order to crimp the conductor wire (not illustrated). The main body 16 is shaped into an approximately box shape such as shown in the drawings. As shown in FIG. 4, the two elastic contact or sheet-spring members 18 are placed so that they extend almost parallel with the insertion direction of the tab terminal (left to right in the figure) while curving to the inside of the space 14 so that they can make contact with the corresponding tab terminal. And, as shown in FIG. 5, multiple slots 22 that are aligned in the direction orthogonal to the insertion direction of the tab terminal (up and down in the drawing), and which extend in the insertion direction, are formed in the elastic contact members 18.

The distinctive feature of this device is the mounting structure of the elastic contact members 18, which will now be discussed in detail. As shown in FIG. 4, the elastic contact members 18 are provided in curved shape, with their front ends **18*a* fixed to the main body 16 inside the space 14 and their rear ends 18*b* are able to slide against the unit 16 toward the rear (to the right in the drawing) inside the space 14. More specifically, in this practical embodiment the front ends 18*a* are fixed to the main body by engaging the holes formed in the front ends 18*a* with bumps 24 formed by pushing in specified locations of the main body 16 from the outside toward the inside of the space 14 and then mashing the tops of the bumps 24 to caulk. The elastic contact members 18 may be mounted to the main body 16 when the main body is in a spread out state as shown in FIG. 6, or after the main body 16** has been folded.

As shown in FIGS. 4 and 5, projecting parts 26 that extend in a direction that is approximately orthogonal to the insertion direction of the tab terminals are provided in positions at a specified distance to the rear of the positions of the rear ends **18*b* of the elastic contact members 18. When the elastic contact members 18 are pressed by more than a specified load by the tab terminal inserted inside the space 14, and elastically deform so that their rear ends 18*b* move to the rear, the projecting parts 26 contact their rear ends 18*b* and control their movement, preventing more than a specified deformation of the elastic contact members 18. In this practical embodiment, the projecting parts 26 are formed by pushing in specified locations of the main body 16 from the outside toward the inside of the space as in the case of the projecting parts 24** described above.

Only the front ends **18*a* of the elastic contact members are fixed; the rear ends 18*b* are able to slide against the main body 16 as described above. Therefore, if the corresponding tab terminal is inserted inside the space 14, and makes contact with the elastic contact members 18, it presses these elastic contact members 18 and they flex, deforming in the vertical direction as their rear ends 18*b* slide to the rear. Consequently, the corresponding tab terminal can be easily inserted and removed with a small force, and it becomes possible to effect reliable contact between the elastic contact members 18** and the corresponding tab terminal.

The elastic contact members 18 can easily be mounted to the main body 16 just by fixing their front ends **18*a* to the main body 16, so they are easy to manufacture and costs can be reduced. Moreover, by providing the projecting parts 26, the elastic contact members 18** can be prevented from deforming by more than a specified amount when pressed by more than a specified load by the corresponding tab terminal.

Another practical embodiment of the female electrical terminal of the device will now be described. FIG. 7 is a plan view of the female electrical terminal of this other practical embodiment of this invention, and FIG. 8 is a cross-sectional view at line VIII—VIII in FIG. 7. The elements in this practical embodiment that are the same as in the above practical embodiment are marked by the same symbols used for it, and a detailed explanation of those elements is omitted.

The difference between the female electrical terminal 12 of this practical embodiment and the one described above is that a pair of elastic contact members 18 was provided in the top and bottom of the space 14 in the practical embodiment described above, whereas an elastic contact member 18 is provided only in the bottom of the space 14 in the present practical embodiment. Also, a multiplicity of projecting strips for contact 28, which extend almost parallel with the insertion direction of the corresponding tab terminal (left to right in the drawing) and which are aligned in the direction approximately orthogonal to the direction of insertion, are provided inside the space 14. The projecting strips for contact 28 are formed by pushing in the main body 16 from the outside toward the space 14, as in the case of the bumps 24 and the projecting parts 26. The remaining parts of its construction are similar to those of the practical embodiment described above in FIGS. 1–6, and therefore a description thereof is omitted.

Figure 9:
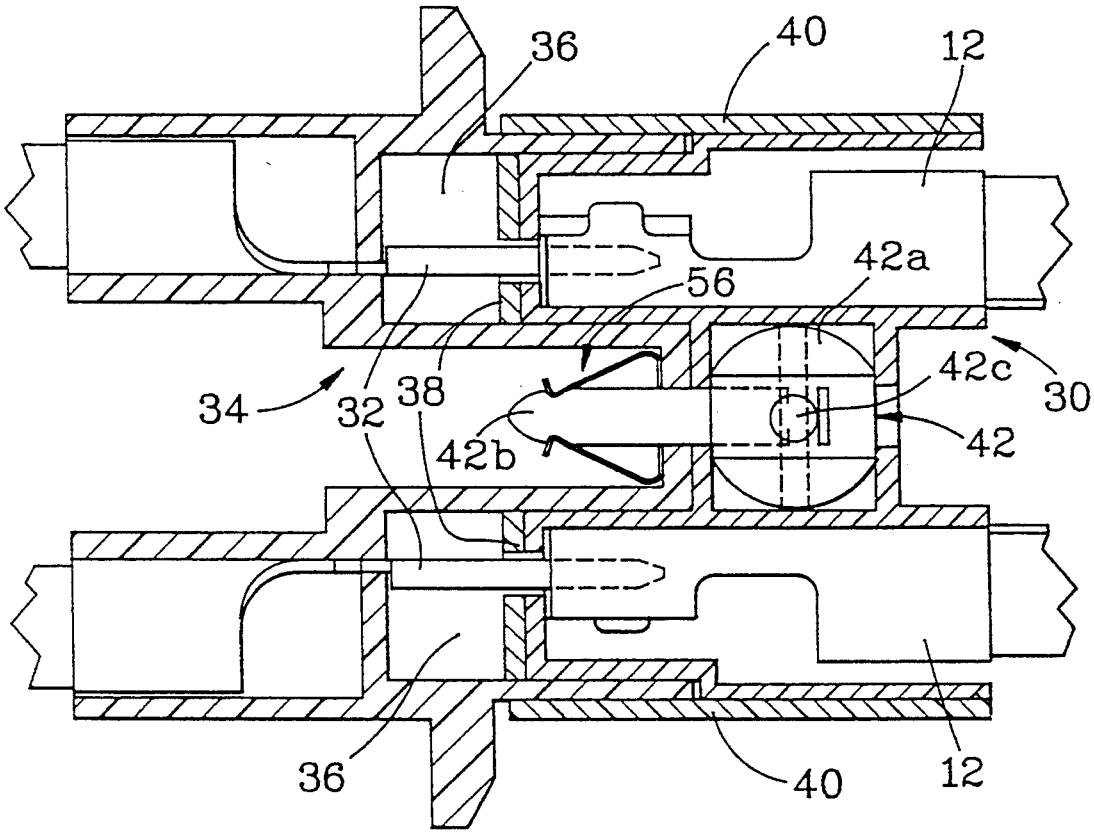
FIG. 9 is a longitudinal section showing one example of the housing that accommodates the female electrical terminal of this device.

FIG. 9 is a longitudinal section that shows one example of the housing that accommodates the female electrical terminal of this device. FIG. 10 shows the action of the inserting/removing aid provided in the housing shown in FIG. 9.

FIG. 9 shows the male housing 30 that accommodates the female electrical terminals 12 of this device in two levels, upper and lower, and a female housing 34 that accommodates the corresponding tab terminals 32 in two levels, upper and lower, in their completely fitted states. Inside the insertion part 36 of the female housing 34 into which the male housing 30 is inserted, there is provided a moving plate 38 which is able to move through the insertion part 36 in the insertion direction of the male housing (left to right in the drawing) and which has been energized to the right in the drawing. On the outside of the female housing 34, there is provided a cover member 40 to protect the tab terminal 32.

The actions of fitting together and separating the housings 30 and 34 are carried out easily with the fitting/removing aid 42. The action of this fitting/removing aid 42 will now be explained. As shown in FIG. 11, the fitting/removal aid 42 consists of a base **42*a* with a shape that combines a cylinder and part of a sphere, a shaft 42*b* mounted on one end of the base 42*a* so that it can turn almost 90 degrees with respect to that base 42*a* as shown in FIG. 13 and 13, and an operating lever 42*c*, which is fixed to the other end of the base 42** and which extends linearly from that other end.

This fitting/removing aid 42 is mounted in the male housing 30 so that the base **42*a* is accommodated inside an accommodating part 44 provided in the male housing 30, the shaft 42*b* sticks out of the hole 46 formed in the front wall of this accommodating part 44 toward the housing 34 side of the female housing 34, and the operating lever 42*c* sticks out of a slot 48 formed in the rear wall of the accommodating part 44. On the other hand, an insertion hole 50 in which the shaft 42*b* of the fitting/removing aid 42 is inserted when fitted together with the male housing 30 is formed in the female housing 34. In the location where the insertion hole 50 is formed, it has a latch 54 that engages with an engaging recess 52 formed in the tip of the shaft 42*b***.

After the two housings 30 and 34 have been fitted together in the tentatively fitted-together state shown and with the shaft **42*b* of the fitting/removing aid 42 and operating lever 42*c* sandwiching the base 42*c* and lined up in a straight line as shown in FIG. 10, the engaging recess 52 of the shaft 42*b* and the latching part 54 of the elastic latching member 56 become engaged as shown in FIG. 11 by turning the operating lever 42*c* approximately 90 degrees as shown in FIGS. 12 and 13 together with the base 42*a* (this time, base 42*a* moves around the mounting point C of the shaft 42*b* to the base 42*a* through the accommodating part 44). To separate the two housings 30 and 34 are fitted together up to the tentatively fitted-together state, the engaging recess 52 of the shaft 42*b* and the latching part 54 of the elastic engaging member 56 can be engaged abruptly by fitting the two together with the fitting/removing aid 42 still in the state shown in FIG. 10(*b*)** from the beginning.

Figure 14:
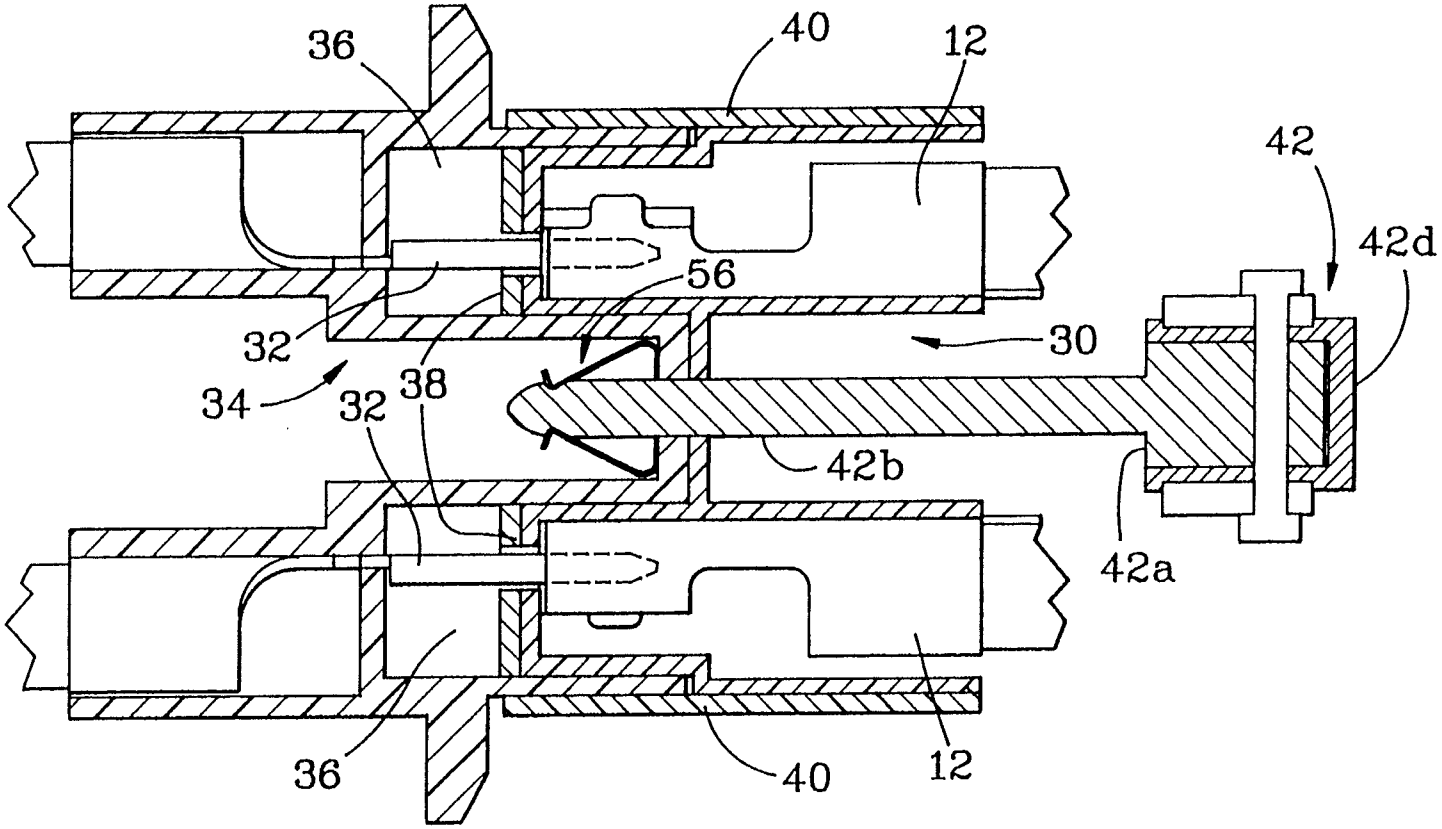
FIG. 14 is a longitudinal section that shows another example of the housing that accommodates the female electrical terminal of this device.
Figure 15B:
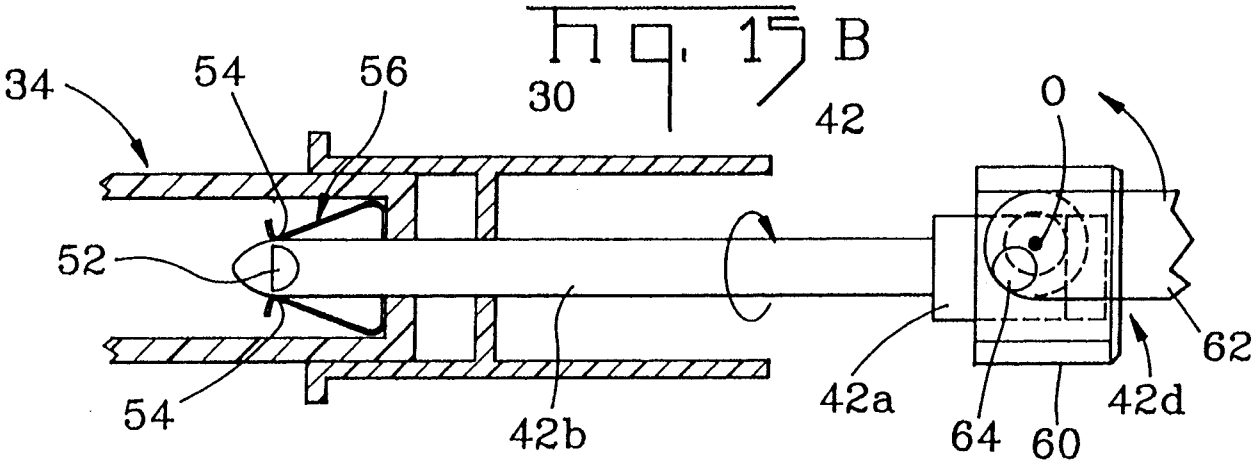
Figure 15A:
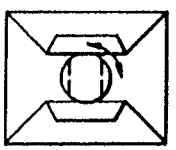
Figure 16B:
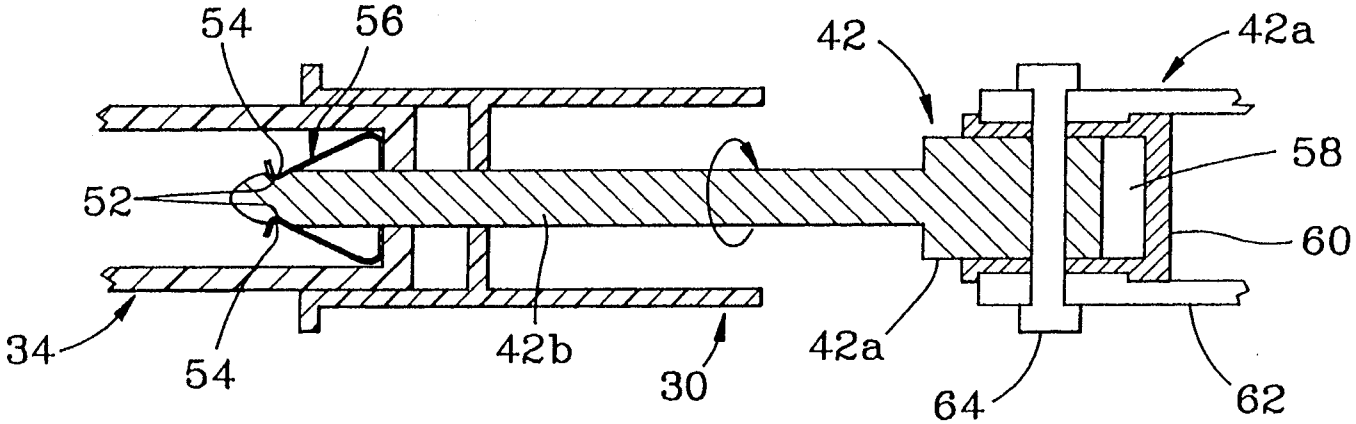
Figure 16A:
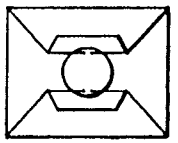

Another example of the housing will now be described. FIG. 14 is a longitudinal section that shows another example of the housing that accommodates the female electrical terminal of this device. FIGS. 15–18 show the action of the fitting/removing aid provided in the housing shown in FIG. 14. The important elements of the housing of this example that are the same as those in the example described above are identified with the same symbols, and a detailed explanation thereof is omitted.

The difference between this example and that described above is the construction of the fitting/removing aid 42. That is, as shown in FIGS. 15–18, the fitting/removing aid 42 of this example is composed of a base **42*a* of approximately rectangular solid form, a shaft 42*b* that is fixed to this base 42*a* and extends linearly, and an operating part 42*d* that is mounted on the base 42*a*. The operating part 42*d* consists of a case that has an accommodating part 58 in which the base 42*a* is accommodated free to slide, a lever 62 engaged so that it is free to turn on the outside of the case 60, and a pin 64 that connects and joins the lever 62 and the case 60 at a position offset from the center of rotation 0 of the lever 62. This pin 64 is also inserted through an insertion hole 66 with an oval cross section formed in the base 64, and thereby the operating part 42*d* is mounted to the base 42*a***.

The operation of the fitting/removing aid of this example is similar to that of the example described above. Since its action will be clear from the drawings, no explanation is given. In the state shown in FIG. 18, namely, in the state in which the engaging recess 52 formed in the tip of the shaft **42*b* and the latching part 54 of the elastic latching member 56 are engaged with each other, the case 60 and the male housing 30 are fixed to each other by some means that is not illustrated. This makes it possible to place the two housings 30 and 34 in the completely fitted state by turning the lever 62 as shown in FIGS. 17 and 18**.

We claim:

1. A female electrical connector for use with a tab contact comprising:

a main body portion having a crimpable termination portion and a tab contact mating portion;

said tab contact mating portion includes a top wall and a bottom wall, each of said walls includes an inside surface which faces the tab contact when the contact is in an inserted position;

at least one of said walls includes a sheet-spring member disposed on its respective inside surface, the sheet-spring has apertures at a proximal end edge, slots directed along an insertion direction of the tab, and a free terminal end edge opposite said proximal end edge;

and wherein said proximal end edge comprises means for fixing said sheet-spring member to said main body to thereby prevent relative motion between the proximal end edge and the main body.

2. The female electrical connector of claim 1, wherein the sheet-spring member has an arcuate cross-section prior to deformation of said sheet-spring member.

3. The female electrical connector of claim 1, wherein the means for fixing comprises inwardly directed bumps which project from said at least one wall, are disposed in said apertures, and are flattened at a top end for fixation of said sheet-spring member proximal end edge.

4. The female electrical connector of claim 1, wherein the tab contact mating portion has a generally rectangular cross-section which is broader than said crimpable termination portion.

5. The female electrical connector of claim 1, wherein the at least one wall further includes a stop means for engaging the terminal end edge when the tab contact is fully inserted.

6. The female electrical connector of claim 5, wherein said stop means comprises an inwardly directed ridge which abuts a portion of said terminal end edge when said tab is fully inserted.

7. A female electrical connector for use with a tab contact comprising:

a main body portion having a longitudinal axis, a crimpable termination portion, and a tab contact mating portion;

said tab contact mating portion includes a top wall and a bottom wall, each of said walls includes an inside surface which faces the tab contact when the contact is in an inserted position;

at least one of said walls includes a sheet-spring member disposed on its respective inside surface and has a proximal end edge, slots directed along an insertion direction of the tab, and a free terminal end edge means disposed axially away from said proximal end edge for axially reciprocating from a extended position, when the tab contact is inserted, to a retracted position, when the tab contact is removed;

the at least one wall inside surface further includes a stop means for engaging the terminal end edge when the tab contact is fully inserted; and wherein said proximal end edge comprises means for rigidly fixing the position of said sheet-spring member relative to said tab contact mating portion.

8. The female electrical connector of claim 7, wherein the sheet-spring member has an arcuate cross-section prior to deformation of said spring.

9. The female electrical connector of claim 7, wherein the means for fixing comprises inwardly directed bumps which are disposed in said aperture and are flattened at an end for fixation of said sheet-spring member.

10. The female electrical connector of claim 7, wherein said stop means comprises an inwardly directed ridge which abuts a portion of said terminal end edge when said tab is fully inserted.

11. The female electrical connector of claim 7, wherein the tab contact mating portion has a generally rectangular cross-section which is broader than said crimpable termination portion.

* * * * *